United States Patent [19]

Berman et al.

[11] 4,151,489

[45] Apr. 24, 1979

[54] WAVEGUIDE SWITCH HAVING FOUR PORTS AND THREE CONNECTING STATES

[75] Inventors: Arnold L. Berman, Kensington, Md.; Christoph E. Mahle, Washington, D.C.; Francois T. Assal, Bethesda, Md.

[73] Assignee: Communications Satellite Corporation, Washington, D.C.

[21] Appl. No.: 851,659

[22] Filed: Nov. 15, 1977

[51] Int. Cl.[2] ..... H01P 1/12; H01P 1/14; H01P 1/15

[52] U.S. Cl. ..... 333/103; 333/101

[58] Field of Search ..... 333/7 R, 7 D, 98 S

[56] References Cited

U.S. PATENT DOCUMENTS

| | | | |
|---|---|---|---|
| 2,644,926 | 7/1953 | Varela | 333/7 R |
| 2,984,797 | 5/1961 | Wheeler | 333/7 R |
| 3,227,977 | 1/1966 | Riblet | 333/98 S |
| 4,070,637 | 1/1978 | Assal et al. | 333/7 R |

*Primary Examiner*—Paul L. Gensler

*Attorney, Agent, or Firm*—Sughrue, Rothwell, Mion, Zinn and Macpeak

[57] ABSTRACT

A four-port waveguide switch is described which allows any two pairs of ports to be connected together. A separate waveguide independently connects each port with each of the remaining ports. In each of the six separate waveguides there is provided at least one resonant cavity having a passband that includes the frequencies of the incident microwave signals to be switched. A disrupting structure is provided for each resonant cavity. Each disrupting structure may be switched between a first state wherein the respective cavity is not detuned and a second state wherein the respective cavity is detuned such that it reflects the incident microwave signals. By switching the appropriate disrupting structures to their second state, any of the three possible connecting states of a four port switch of the present invention can be obtained.

5 Claims, 12 Drawing Figures

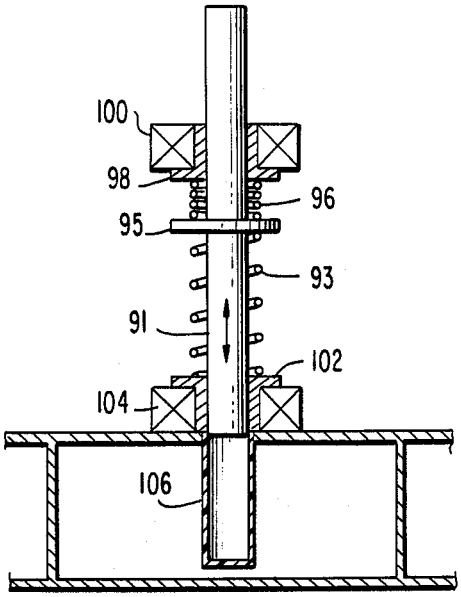
FIG. 9
FIG. 10
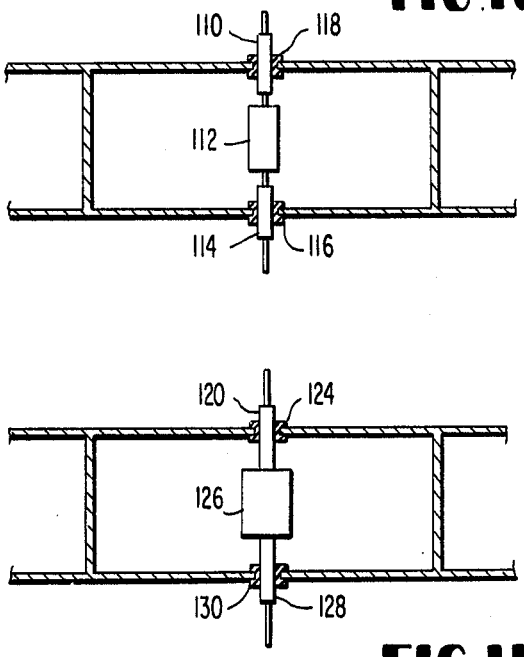
FIG. 11
FIG. 12
| | WAVE GUIDES | | | | | |
|---|---|---|---|---|---|---|
| | 40 | 42 | 44 | 46 | 48 | 50 |
| CONNECTING STATE 1 : PORT 1 CONNECTED TO PORT 2, PORT 3 CONNECTED TO PORT 4 | D | | D | | D | D |
| CONNECTING STATE 2 : PORT 1 CONNECTED TO PORT 3, PORT 2 CONNECTED TO PORT 4 | | D | | D | D | D |
| CONNECTING STATE 3 : PORT 1 CONNECTED TO PORT 4, PORT 3 CONNECTED TO PORT 2 | D | D | D | D | | |
KEY : D = CAVITY IS DETUNED, THUS INCIDENT ELECTROMAGNETIC ENERGY IS REFLECTED AND NOT PROPAGATED.

WAVEGUIDE SWITCH HAVING FOUR PORTS AND THREE CONNECTING STATES

BACKGROUND OF THE INVENTION

1. Field of the Invention

The present invention relates generally to waveguide switches and particularly to a waveguide switch having four ports and three connecting states.

2. Description of the Prior Art

In order to improve the reliability of communication systems, it has been the practice to provide redundant elements in the system which are switched in to replace system elements which have failed. For example, it is common to provide in a communication system standby units, such as receivers and transmitters, which are appropriately switched to replace main units that have failed.

The switching apparatus needed in such redundancy systems proved easy to provide when systems operated at low frequencies or at low transmitter power levels. But with the move to higher frequencies and power levels, existing switching apparatus has proved to be inadequate. The deficiency is particularly acute in the communication satellite area where the high cost of an orbited satellite requires the maximum possible switchable combinations of system elements, but also requires a very light and small switch.

As disclosed in pending application Ser. No. 670,290, filed Mar. 25, 1976 to Assal et al, now U.S. Pat. No. 4,070,637, the switch needed for higher order satellite system redundancy configurations is one having four ports and three connecting states, referred to as a R switch, as shown in FIG. 1. The R switch must provide minimal attenuation in the conducting paths and maximum isolation in the non-conducting paths.

Since satellite communication systems operate at very high frequencies, the R switch must be able to operate efficiently at these frequencies. As is well known in the microwave art, waveguide switches have the best electrical characteristics at these high frequencies. However, the known waveguide switch which provides the three connecting states is not suitable in satellite communication systems because of several deficiencies including excessive size, weight and cost.

A known non-waveguide switch which provides the three connecting states of the present invention is the microwave matrix switch of Lee Laboratories, Lexington, Massachusetts. This microwave matrix switch uses connectors instead of waveguide ports and, therefore, is unsuitable for satellite communication systems where low loss and high power capability are required.

A known waveguide switch called a B switch, as illustrated in FIG. 2, can provide only the first and second connecting states shown in FIG. 1. One such B switch is available from Sivers Labs in Stockholm, Sweden and is designated PM 7306J. As shown in FIG. 2, the B switch can provide the first connecting state with port 1 connected to port 2 and port 3 connected to port 4. The B switch can also provide the second connecting state with port 1 connected to port 3, and port 2 connected to port 4. The B switch cannot provide the third connecting state, since port 1 cannot be connected to port 4 simultaneously with port 2 being connected to port 3.

A known waveguide switch called the modified B switch provides the three connecting states of the present invention. As is apparent below, however, the modified B switch has several major deficiencies with respect to satellite communication systems including excessive size, weight, and cost.

A modified B switch, as shown in FIGS. 3 and 4, includes an unmodified B switch which is now described. The B switch is housed in a square structure designated generally by reference numeral 30. Ports 20, 22, 24 and 26 are provided in successive 90° intervals around structure 30. For purposes of description and with reference to FIG. 2, port 20 corresponds to port 1, port 22 corresponds to port 2, port 24 corresponds to port 4, and port 26 corresponds to port 3. A structure 28, mounted for rotation on a drive shaft 10, is provided in structure 30. A waveguide 12 is mounted to structure 28 and has a length such that it can electrically couple port 22 to port 26, or port 20 to port 24 depending on the angle of rotation of shaft 10. A curved waveguide 16 is mounted to structure 28 and has a curve and length such that it can electrically couple port 20 to port 22, port 22 to port 24, port 24 to port 26, or port 26 to port 20 depending on the angle of rotation of shaft 10. Similarly, a curved waveguide 14 is mounted to structure 28 and has a curve and length such that it can electrically couple port 24 to port 26, port 26 to port 20, port 20 to port 22, or port 22 to port 24 depending on the angle of rotation of shaft 10. Obviously, with this unmodified B switch, it is impossible to provide the third connecting state of the present invention, since port 20 cannot be connected to port 24 simultaneously with the connection of port 22 to port 26.

In order to provide the third connecting state of the present invention, the B switch can be modified in the following fashion. Specifically, a waveguide 18 having four 90° bends can be mounted to structure 28 perpendicular to and below waveguide 12; waveguide 18 has a length such that it can electrically couple port 20 to port 24, or port 22 to port 26 depending on the angle of rotation of shaft 10.

While the modified B switch provides the three connecting states, it has several major deficiencies. First, in order to provide waveguide 18, the height of structure 30 has to be at least doubled, and the length and width of structure 30 has to be increased to accommodate the four required 90° bends in waveguide 18. In a satellite, size is extremely critical. Second, the addition of waveguide 18 requires a larger diameter shaft 10 and a larger source to drive shaft 10. In a satellite, weight is extremely critical. Third, both a modified and an unmodified B switch require close tolerance components due to rotation required to perform the switching function, and these critical dimensions resulted in added manufacturing costs.

Furthermore, there are several known waveguide switches that do not provide the three connecting states of the present invention. Specifically, a waveguide switch is disclosed in U.S. Pat. No. 2,164,792 which provides only a single-pole single-throw connecting state. A waveguide switch is disclosed in U.S. Pat. No. 3,546,633 which also provides only a single-pole single-throw connecting state. A waveguide switch is disclosed in U.S. Pat. No. 3,953,853 which provides only a single-pole double-throw connecting state. Finally, a waveguide switch is disclosed in U.S. Pat. No. 3,768,041 which also provides only a single-pole double-throw connecting state.

SUMMARY OF THE INVENTION

Therefore, it is an object of the present invention to provide a waveguide switch having four ports and three connecting states.

It is an additional object of the present invention to provide a waveguide switch that is small in size, light in weight and economical to manufacture.

It is a further object of the present invention to provide a waveguide switch not requiring the rotation of a shaft to achieve the switching function.

Other objects and advantages of the invention will become apparent in the following description.

According to the present invention, there is provided between each pair of ports a connecting waveguide. Since there are four ports in the present invention, six connecting waveguides are provided. The connecting waveguides are dimensioned to allow propagation of the incident electromagnetic energy with minimal attenuation. Each connecting waveguide is provided with at least one cavity, each cavity having a passband that includes the frequency of the incident electromagnetic energy. When one cavity is provided in a connecting waveguide, a structure for disrupting the passband of the cavity is provided. The disrupting structure is switchable between two states. In the first state, the disrupting structure does not detune the cavity and thus the incident electromagnetic energy is allowed to propagate therethrough. In the second state, the disrupting structure detunes the cavity sufficiently such that the incident electromagnetic energy is prevented from propagating therethrough. When more than one cavity is provided in a connecting waveguide, a disrupting structure is provided for only two cavities, the two cavities being those most electrically adjacent to their respective port. The three connecting states between the four ports of the waveguide switch of the present invention are achieved by the appropriate switching of all of the disrupting structures.

The features and advantages of the present invention are better understood from the following detailed description of preferred embodiments of the present invention when taken in conjunction with the accompanying drawings.

BRIEF DESCRIPTION OF THE DRAWINGS

FIG. 9 is a partial sectional view of the first embodiment of the disrupting stucture of the present invention.

FIG. 10 is a partial sectional view of the second embodiment of the disrupting structure of the present invention;

FIG. 11 is a partial sectional view of the third embodiment of the disrupting structure of the present invention; and FIG. 12 is a switching matrix showing the necessary electrical state of each waveguide shown in FIG. 6 in order to achieve the three connecting states of the present invention.

DESCRIPTION OF THE PREFERRED EMBODIMENT

Figure 1:
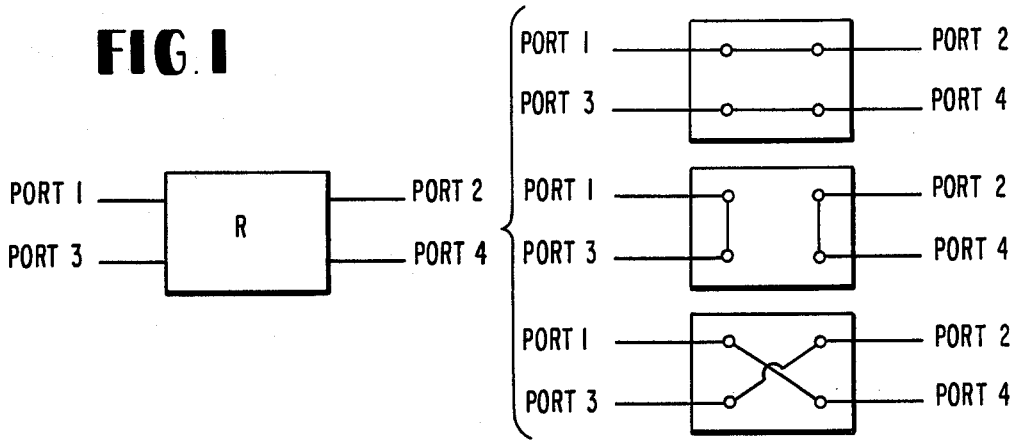
FIG. 1 is a block and functional diagram of a four-port switch of the present invention.
Figure 2:
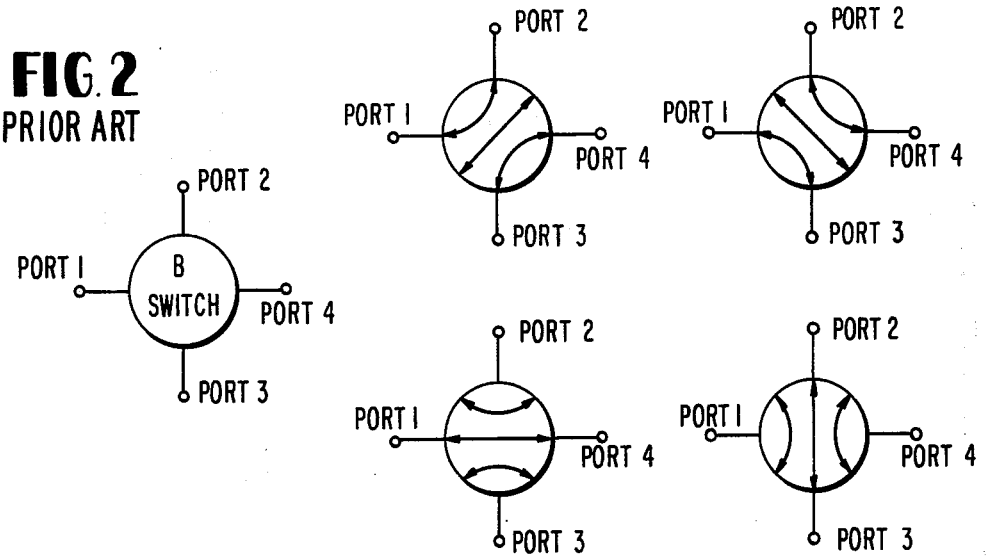
FIG. 2 PRIOR ART
FIG. 2 is a block and functional diagram of the prior art four-port microwave switch.
Figure 3:
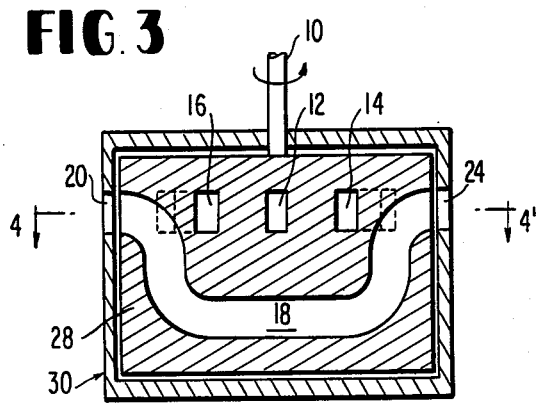
FIG. 3 is a sectional view taken along 3—3' in FIG. 4 illustrating a modified version of the B switch of FIG. 2 that provides the three connecting states of the present invention.
Figure 4:
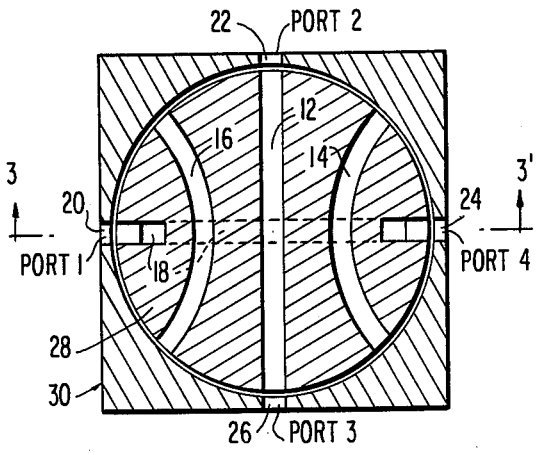
FIG. 4 is a sectional view taken along line 4—4' of FIG. 3 illustrating the modified version of the B switch of FIG. 2.

The three connecting states of the four-port waveguide switch of the present invention are functionally illustrated in FIG. 1. In the first connecting state, port 1 is connected to port 2, and port 3 is connected to port 4. In the second connecting state, port 1 is connected to port 3, and port 2 is connected to port 4. In the third connecting state, port 1 is connected to port 4, and port 3 is connected to port 2. It is apparent in the following description that the switch of the present invention is symmetrical in each of the three connecting states; this allows the incident electromagnetic energy to be applied to either port of a connected pair of ports.

Figure 5:
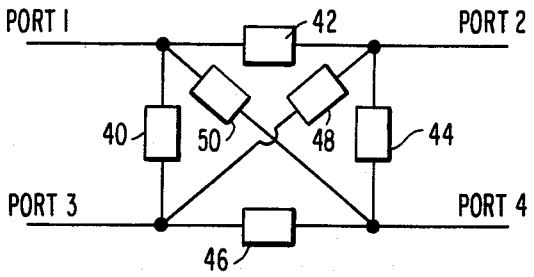
FIG. 5 is an electrical network analog of the four-port switch of the present invention.

The waveguide switch of the present invention, which is now described, overcomes all of the deficiencies of a B switch, modified or unmodified. The electrical analog of the waveguide switch of the present invention is shown in FIG. 5. A waveguide which electrically couples port 1 to port 3 is designated generally by the reference numeral 40. A waveguide which electrically couples port 1 to port 2 is designated generally by the reference numeral 42. A waveguide which electrically couples port 2 to port 4 is designated generally by the reference numeral 44. A waveguide which electrically couples port 3 to port 4 is designated generally by the reference numeral 46. A waveguide which electrically couples port 2 to port 3 is designated generally by the reference numeral 48. A waveguide which electrically couples port 1 to port 4 is designated generally by the reference numeral 50.

Each waveguide 40, 42, 44, 46, 48, and 50 may be of any shape or length as long as it can propagate the incident electromagnetic energy with minimal attenuation and can accommodate at least one resonant cavity, discussed below. As is well known to those in the microwave art, the best materials for construction of waveguide walls with respect to minimal attenuation are solid silver, silver-plated copper, and aluminum.

Each waveguide 40, 42, 44, 46, 48, and 50 has at least one resonant cavity. Each resonant cavity is constructed such that its bandwidth is sufficient to pass the incident electromagnetic energy with minimal attenuation.

Figure 6:
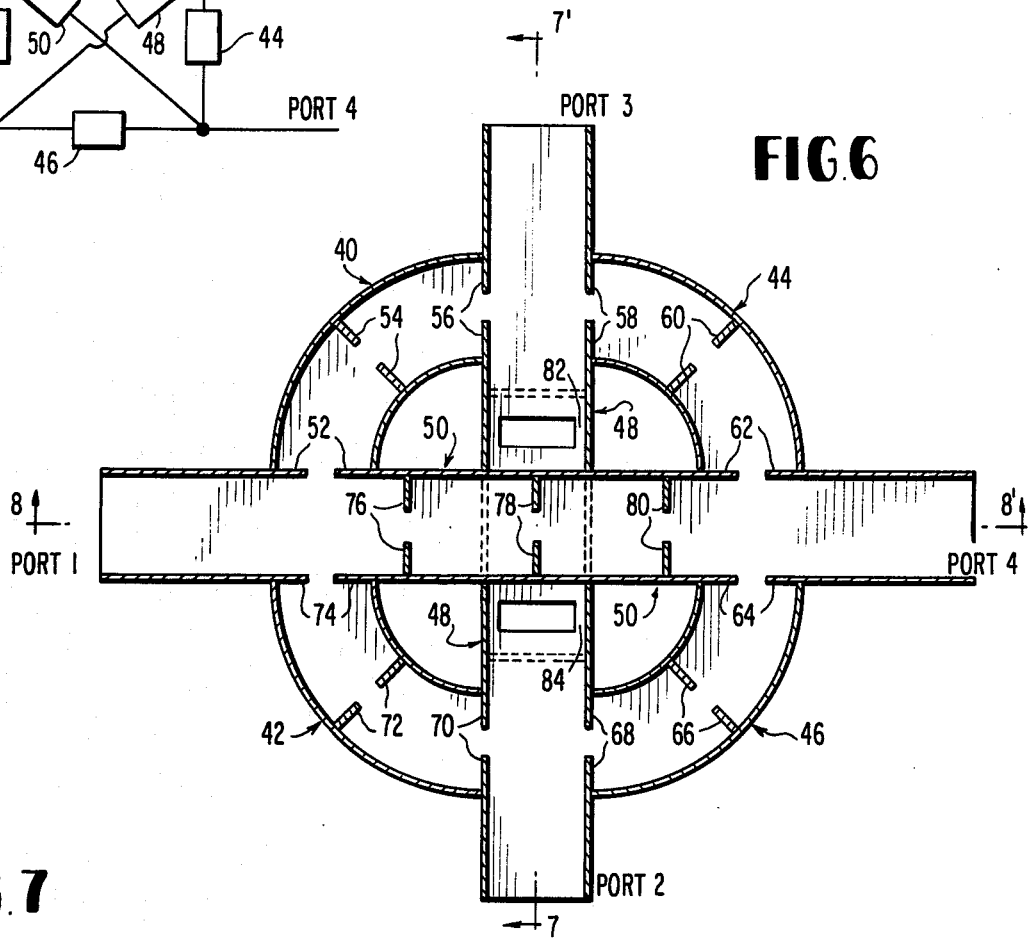
FIG. 6 is a top plan view with the entire top wall removed of the waveguide structure of the four-port switch of the present invention.
Figure 7:
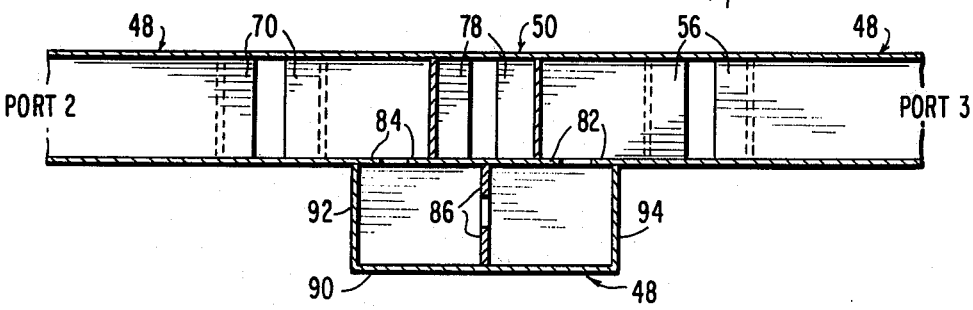
FIG. 7 is a sectional view taken along line 7—7' of FIG. 6 illustrating in particular the two cavities that couple port 2 to port 3.
Figure 8:
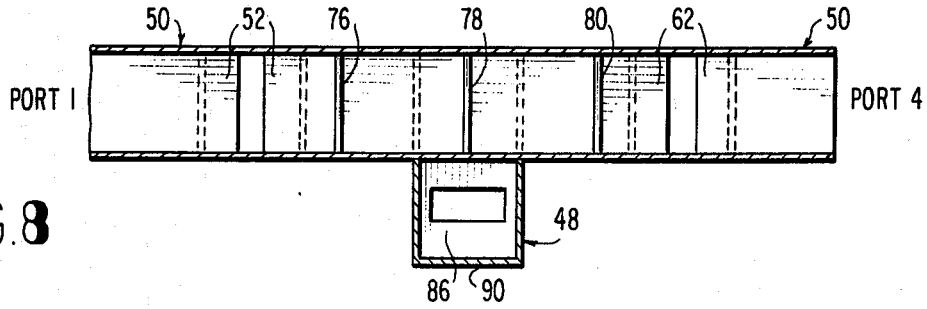
FIG. 8 is a sectional view taken along line 8—8' of FIG. 6 illustrating the two cavities that couple port 1 to port 4.

Turning now to FIGS. 6, 7 and 8, the preferred embodiments of the switch of the present invention are shown. Like numerals refer to like elements. Each waveguide 40, 42, 44, 46, 48 and 50 is represented as being rectangular and having two resonant cavities, but this is done only for purposes of description and in no way is meant to limit the scope of the invention.

Waveguide 40 is sidewall coupled to port 1 by an iris provided in a wall 52, and is sidewall coupled to port 3 by an iris provided in a wall 56. A wall 54 having an iris is provided in waveguide 40 between walls 52, 56. The spacing of walls 52, 54, 56, and the size of the respective irises is such that each of the two resonant cavities formed thereby in waveguide 40 has a bandwidth sufficient to pass the incident electromagnetic energy with minimal attenuation. It is obvious to those skilled in the microwave art that any sort of tuning device (not shown), for example, a tuning screw, may be provided for each of the above cavities or for the cavities described below in order to provide a means for fine tuning the center frequency of the respective cavity.

Waveguide 42 is sidewall coupled to port 1 by means of an iris provided in a wall 74, and is sidewall coupled to port 2 by an iris provided in a wall 70. A wall 72 having an iris is provided in waveguide 42 between walls 70, 74. The spacing of walls 70, 72, 74, and the size of the respective irises is such that each of the two resonant cavities formed thereby in waveguide 42 has a bandwidth sufficient to pass the incident electromagnetic energy with minimal attenuation.

Waveguide 44 is sidewall coupled to port 3 by an iris provided in a wall 58, and is sidewall coupled to port 4 by an iris provded in a wall 62. A wall 60 having an iris is provided in waveguide 44 between walls 58, 62. The spacing of walls 58, 60, 62 and the size of the respective irises is such that each of the two resonant cavities formed thereby in waveguide 44 has a bandwidth sufficient to pass the incident electromagnetic energy with minimal attenuation.

Waveguide 46 is sidewall coupled to port 4 by an iris provided in a wall 64, and is sidewall coupled to port 2 by an iris provided in a wall 68. A wall 66 having an iris is provided in waveguide 46 between walls 64, 68. The spacing of walls 64, 66, 68 and the size of the respective irises in such that each of the two resonant cavities formed thereby in waveguide 46 has a bandwidth sufficient to pass the incident electromagnetic energy with minimal attenuation.

Waveguide 48 is broadwall coupled to port 2 by an iris provided in a wall 84, and is broadwall coupled to port 3 by an iris provided in a wall 82. An end wall 92 and an end wall 94, together with a wall 90 define waveguide 48 in the section thereof that is disposed below waveguide 50. A wall 86 having an iris is provided between end walls 92, 94. The spacing of walls 82, 84, 86, 90, and endwalls 92, 94 and the size of the respective irises is such that each of the two resonant cavities formed thereby in waveguide 48 has a bandwidth sufficient to pass the incident electromagnetic energy with minimal attenuation.

Waveguide 50 is coupled to port 1 by an iris provided in a wall 76, and is coupled to port 4 by an iris provided in a wall 80. A wall 78 having an iris is provided in waveguide 50 between walls 76, 80. The spacing of walls 76, 78, 80 and the size of the respective irises is such that each of the two resonant cavities formed thereby in waveguide 50 has a bandwidth sufficient to pass the incident electromagnetic energy with minimal attenuation.

A disrupting structure is provided for each of the resonant cavities shown in FIGS. 6, 7 and 8, the purpose of which is described below. It should be noted that when more than two resonant cavities are provided in a waveguide connecting two ports, a disrupting structure is provided only for the two resonant cavities that are electrically adjacent to the respective ports. The purpose of the disrupting structure is to disrupt the passband of the resonant cavity such that the resonant cavity reflects the incident electromagnetic energy and thus prevent its passage therethrough. As is apparent to anyone skilled in the microwave art, when there are two resonant cavities connecting two ports, and each resonant cavity is provided with a disrupting structure, the amount the incident electromagnetic energy is attenuated is approximately equal to the sum of the dB attenuation caused by each detuned resonant cavity.

A first embodiment of a disrupting structure, as illustrated in FIG. 9, has a plunger 91 that can be mechanically inserted into a resonant cavity to detune the cavity. Plunger 91 is preferably made of a metal, such as silver, silver-plated copper, or aluminum, but may be made of any material that conducts electricity. Plunger 91 is mounted for lateral movement in an insulating sleeve 106. Insulating sleeve 106 is disposed in the resonant cavity to be detuned. Insulating sleeve 106 is preferably made of Teflon, but may be made of any material that does not conduct electricity.

Plunger 91 has a washer 95 mounted on the region of plunger 91 that is not inserted into insulating sleeve 106. Washer 95 is disposed between a first solenoid winding 100 and a second solenoid winding 104. First solenoid winding 100 has an insert 98, preferably made of iron, that is disposed around plunger 91. Second solenoid winding 104 has an insert 102, preferably made of iron, that is disposed around plunger 91. Plunger 91 is normally urged towards first solenoid winding 100 by a spring 93 wrapped around plunger 91 and disposed between second solenoid winding 104 and washer 95. Plunger 91 is normally urged towards second solenoid winding 104 by a spring 96 wrapped around plunger 91 and disposed between first solenoid winding 100 and washer 95. Because of the urging of springs 93, 96, washer 95 is normally disposed at the midpoint between first solenoid winding 100 and second solenoid winding 104. Thus, plunger 91 is normally inserted half-way into insulating sleeve 106 which is designated as the third position.

The operation of plunger 91 is now described. When first solenoid winding 100 is energized by a source of electric energy and second solenoid winding 104 is not energized, washer 95 is translated to the position adjacent insert 98, as shown in FIG. 9, which results in plunger 91 being outside the resonant cavity. This is designated the first position. When second solenoid winding 104 is energized by a source of electric energy and first solenoid winding 100 is not so energized, washer 95 is translated to the position adjacent insert 102, which results in plunger 91 being inserted the maximum amount into insulating sleeve 106. This is designated the second position. In this second position, plunger 91 detunes the resonant cavity such that the resonant cavity reflects the incident electromagnetic energy and, thus, does not let it propagate therethrough. Thus, when plunger 91 is in the first position, the waveguide cavity propagates the incident electromagnetic energy; when plunger 91 is in the second position, the waveguide cavity reflects the incident electromagnetic energy.

A second embodiment of a disrupting structure, as illustrated in FIG. 10, has a two-state solid-state device 112, preferably a diode, disposed in a resonant cavity. A first lead of device 112 is electrically connected to a first metal post 110 which passes through the wall of the resonant cavity. First metal post 110 is electrically insulated from the wall of the resonant cavity by an insulating washer 118. A second lead of device 112 is electrically connected to a second metal post 114 which passes through the wall of the resonant cavity. Second metal post 114 is electrically insulated from the wall of the resonant cavity by an insulating washer 116.

Device 112 is electrically switchable between two states. The first state, or OFF state, is when device 112 is reverse biased into the non-conduction state by an electric power supply (not shown) connected between leads 110, 114. In the first state, device 112 does not detune the resonant cavity and the incident electromagnetic energy is allowed to propagate therethrough. The second state, or ON state, is when device 112 is forward biased into the conduction state by an electric power supply (not shown) connected between leads 110, 114. In the second state, device 112 detunes the resonant cavity and the incident electromagnetic energy is reflected.

A third embodiment of a disrupting structure, as illustrated in FIG. 11, has a two-state gaseous discharge device disposed in a resonant cavity. A first lead of device 126 is electrically connected to a first metal post 120 which passes through the wall of the resonant cavity. First metal post 120 is electrically insulated from the wall of the resonant cavity by an insulating washer 124. A second lead of device 126 is electrically connected to a second metal post 128 which passes through the wall of the resonant cavity. Second metal post 128 is electrically insulated from the wall of the resonant cavity by an insulating washer 130.

Device 126 is electrically switchable between two states. The first state, or OFF state, is when the gas of device 126 is not ionized by an electric power supply (not shown) connected between leads 120, 128. In the first state, device 126 does not detune the resonant cavity and the incident electromagnetic energy is allowed to propagate therethrough. The second state, or ON state, is when the gas of device 126 is ionized by an electric power supply (not shown) connected between leads 120, 128. In the second state, device 126 detunes the resonant cavity and the incident electromagnetic energy is reflected.

The operation of the waveguide switch of the present invention is as follows. Referring to FIG. 12, connecting state 1 results when the disrupting structures associated with waveguides 40, 44, 48, 50 detune those waveguides. Connecting state 2 results when the disrupting structures associated with waveguides 42, 46, 48, 50 detune those waveguides. Connecting state 3 results when the disrupting structures associated with waveguides 40, 42, 44, 46 detune those waveguides.

Although a number of specific embodiments of the disrupting structure have been described, it will be obvious to those having ordinary skill in the microwave art that the invention is not limited thereto since other such disrupting structures may be used without departing from the scope and spirit of the invention.

What is claimed is:

1. A microwave switch for switching two independent microwave signals, comprising:

four waveguide ports;

six waveguide transmission means for providing transmission paths for microwave signals, each of said ports being electrically connected to each of the remaining said ports by one of said waveguide transmission means;

at least one tuning means for each of said waveguide transmission paths for switching between a first state wherein the passband of said waveguide transmission means is unchanged and a second state wherein said passband of said transmission means is detuned such that the incident microwave signals are reflected and not propagated therethrough, said tuning means for all said waveguide transmission paths being independently switchable between said first and second states, whereby any two of said ports may be electrically connected together independently of the remaining two of said ports.

2. A waveguide switch as claimed in claim 1, wherein each said transmission means comprises:

at least two coupling irises and at least one resonant cavity therein having a passband that includes the frequencies of said independent microwave signal.

3. A microwave switch for switching two independent microwave signals as claimed in claim 2, wherein each of said tuning means comprises a hollow electrically-insulating sleeve disposed in a respective one of said resonant cavities and having an opening outside said respective resonant cavity, an electrically conductive plunger movably mounted in said hollow sleeve and which extends beyond said opening outside said respective resonant cavity, solenoid means responsive to an electric signal for translating an end of said plunger between a first position outside said resonant cavity and a second position inside said resonant cavity, whereby the resonant cavity is detuned in said second position such that the incident microwave signals are reflected and not propagated through said cavity.

4. A microwave switch for switching two independent microwave signals as claimed in claim 2, wherein each of said tuning means comprises a first electrically conductive post electrically insulated from a respective one of said cavities and having a first end inside and a second end outside said respective resonant cavity, a second electrically conductive post electrically insulated from said respective resonant cavity and disposed on the other side of said respective resonant cavity from said first post, said second post having a first end inside and a second end outside said respective resonant cavity, a solid state element having two electrical states disposed in said respective resonant cavity, said solid state element being electrically connected between said first and said second post, said solid state element responsive to an electric signal applied to said first and second posts such that when said electric signal biases said solid state element in the reverse direction said solid state element is non-conductive, and when said electric signal biases said solid state element in the forward direction said solid state element is conductive, whereby the resonant cavity is detuned when said solid state element is biased in the forward direction such that the incident microwave signals are reflected and not propagated therethrough said cavity.

5. A microwave switch for two independent microwave signals as claimed in claim 2, wherein each of said tuning means comprises a first electrically conductive post electrically insulated from a respective one of said cavities and having a first end inside and a second end outside said respective resonant cavity, a second electrically conductive post electrically insulated from said respective resonant cavity and disposed on the other side of said respective resonant cavity from said first post, said second post having a first end inside and a second end outside said respective resonant cavity, a gas discharge element having two electrical states disposed in said respective resonant cavity, said gas discharge element being electrically connected between said first and said second post, said gas discharge element responsive to an electric signal applied to said first and second posts such that when said electric signal biases said gas discharge element in the reverse direction said gas discharge element is non-conductive, and when said electric signal biases said gas discharge element in the forward direction said gas discharge element is conductive, whereby the resonant cavity is detuned when said gas discharge element is biased in the forward direction such that incident microwave signals are reflected and not propagated through said cavity.

* * * * *